US005450976A

United States Patent [19]

Chandler

[11] Patent Number: 5,450,976

[45] Date of Patent: Sep. 19, 1995

[54] SUBDIVIDING THE BIN OF AN OPEN-TOPPED REFUSE CONTAINER

[76] Inventor: John W. Chandler, 131 NW. 55th St., Seattle, Wash. 98107

[21] Appl. No.: 100,102

[22] Filed: Jul. 30, 1993

[51] Int. Cl.[6] ..... B65D 90/04

[52] U.S. Cl. ..... 220/404; 220/909

[58] Field of Search ..... 220/404, 909, 528, 529, 220/544

[56] References Cited

U.S. PATENT DOCUMENTS

| | | | |
|---|---|---|---|
| 623,366 | 4/1899 | Halvorsen | 220/529 X |
| 4,750,638 | 6/1988 | Sosower | 220/909 X |
| 4,905,853 | 3/1990 | Strawder | 220/404 X |
| 5,127,538 | 7/1992 | Bach | 220/528 X |
| 5,190,183 | 3/1993 | McNaughton et al. | 220/909 X |
| 5,190,252 | 3/1993 | Schrager | 220/909 X |
| 5,238,139 | 8/1993 | Bisceglia | 220/909 X |

*Primary Examiner*—Steven M. Pollard
*Attorney, Agent, or Firm*—Christopher Duffy

[57] ABSTRACT

A bar 26 comprised of a pair of adjustably interlocked rods 40, 42, with inverted U-shaped cleats 68 rotatably mounted on the relatively remote ends thereof, is supported on the fore and aft rims 18 and 20 of a refuse container 2, so that the open end portion 28 of a plastic sack 30 can be folded over posts 34 on the bar, and over a sidewall rim 22 of the container, and suspended in the bin 6 of the container, to subdivide the bin into a pair of open-topped receptacles 30, 32 for receiving separable components of the refuse, such as recyclable and non-recyclable components thereof.

21 Claims, 3 Drawing Sheets

SUBDIVIDING THE BIN OF AN OPEN-TOPPED REFUSE CONTAINER

TECHNICAL FIELD

This invention relates to a means and technique for subdividing the bin of an open-topped refuse container into a pair of open-topped receptacles within which to segregate separable components of the refuse when the refuse is loaded into the bin. More particularly, it relates to a means and technique of this nature wherein the bin is retrofitted with an open ended sack that is operable to subdivide the bin into a pair of open-topped receptacles, one of which is defined by the sack and the other by the remainder of the bin. Or the bin is retrofitted with a pair of open ended sacks defining the respective receptacles. Commonly, the sack or sacks are removably installed in the bin so that when filled, each can be removed for emptying and/or replacement with a new sack. Meanwhile, the segregation between components is preserved as the respective components remain enclosed within their respective sacks for discharge to a point beyond the container, such as to a collection hopper or to a vehicle for removing refuse from a building. The most common purpose for segregating the separable components is to separate recyclable and nonrecyclable components from one another at the time the refuse is loaded into the bin.

BACKGROUND ART

Compartmentalized refuse containers are known. See my U.S. Pat. Nos. 4,944,419 and 5,062,539. But the compartments in these containers are arranged vertically, and are loaded from the sides, not from the top. Also, each container is a self-contained item and can replace an existing open-topped refuse container only if purchased and substituted for it.

One objective of the present invention is to provide a means and technique whereby the bin of an existing open-topped refuse container can be subdivided into two or more open-topped receptacles within which to load separable components of the refuse, and more particularly, load them in the same way that the refuse was loaded in the first place, that is, through the top opening of the container. Another object is to provide a means and technique of this nature whereby at the time the components are loaded into the respective receptacles, they may be loaded into the same sacks by which they are thereafter removed to a discharge point, such as to a refuse dump, or to a refuse removal vehicle. Still another object is to provide a means and technique of this nature whereby the sacks are so easily installed, loaded, and then removed for emptying and/or replacement with new sacks, that the user is encouraged to undertake a recycling program through the use of the invention. Still other objects will become apparent from the further description of the invention hereinafter.

DISCLOSURE OF THE INVENTION

In practice, all open-topped refuse containers have a generally annular wall structure defining a bin therewithin, a top opening to the bin, pairs of opposing sides of the bin on the right angular coordinates of the container, and rims about the top opening of the bin on the pairs of opposing sides thereof. According to the invention, an elongated bar is interposed between one of the pairs of opposing sides of the bin, in juxtaposition to a vertical plane of the container extending intermediate the other of the pairs of opposing sides of the bin, and the bar is supported on the rims of the one pair of opposing sides in relatively fixed engagement therewith. The open end portion of an open ended sack is releaseably engaged with the bar and with the rim of one of the other pair of opposing sides of the bin, and the sack is removably suspended in that portion of the bin lying between the aforesaid plane of the container and the one side of the other pair of opposing sides of the bin, to subdivide the bin into a pair of open-topped receptacles for receiving the separable components of the refuse. Preferably, the open end portion of a second open ended sack is releaseably engaged with the bar, and with the rim of the other side of the other pair of opposing sides of the bin, and the second sack is removably suspended in the remaining portion of the bin lying between the plane of the container and the other side of the other pair of opposing sides of the bin, so that both receptacles are defined by sacks which are removable from the bin. Preferably, too, the open end portion of each sack is releaseably engaged with the bar at posts relatively upstanding on the respective end portions thereof, and is engaged with the posts, and with the rim of the respective side of the other pair of opposing sides of the bin, by employing sacks of readily foldable stretchable sheet material, such as plastic material, and folding the open end portion of each over the posts and the rim in stretched condition among the posts and rim. However, sacks of some other material may be employed, and a different technique may be employed, so long as the sacks are capable of being releaseably engaged and suspended in the bin of the container as indicated.

Commonly, the open end portions of the sacks are also releaseably engaged with the rims of the one pair of opposing sides of the bin, such as being folded over the same when the sacks are made of foldable material as indicated, so that the sacks are supported substantially about the entire perimeters of their respective portions of the bin. Additionally, the bar is also clamped to the rims of the one pair of opposing sides of the bin, so as to be secured against movement in the planes of the respective sides. Among other things, this renders the sacks more readily disengageable from the bar, and more readily liftable from their respective portions of the bin, when they are to be removed therefrom.

To make it more adjustable in length, in many of the presently preferred embodiments of the invention, the bar is divided into a pair of elongated rods having a joint therebetween, the rods are shifted in relation to one another at the joint to span between the rims of the one pair of opposing sides of the bin, and then the rods are interlocked with one another at the joint to rigidify the bar, and the bar is supported on the rims of the one pair of opposing sides of the bin in relatively fixed engagement therewith. Moreover, when the rims of the one pair of opposing sides of the bin have varied elevations, one of the rods is divided into a pair of elongated sections, the sections are angularly interconnected with one another to form a crooked rod, and then the rods are interlocked with one another at the joint to form a crook in the bar itself when the bar is rigidified. This latter crook enables the bar to be more cleanly supported on the rims, despite their varied elevations. Furthermore, in certain embodiments of the invention, a pair of saddles is rotatably mounted on the relatively remote end portions of the rods to form the end portions of the bar, and after the relatively adjacent end portions of the rods are interlocked with one another to form the rods into the main body of the bar, the saddles are rotated in relation to the main body of the bar and then rested on the rims of the one pair of opposing sides of the bin, and fixedly engaged with both the main body of the bar and the rims on the one pair of the opposing sides of the bin, so as to support the bar on the rims.

In some embodiments, the saddles have recesses in the bottoms thereof and in resting the saddles on the rims of the one pair of opposing sides of the bin, the saddles are straddled about the one pair of opposing sides of the bin so as to receive the rims in the recesses thereof. Then, the saddles are clamped to the rims so as to secure the bar against movement in the planes of the respective one pair of opposing sides of the bin.

BRIEF DESCRIPTION OF THE DRAWINGS

These features will be better understood by reference to the accompanying drawings wherein I have illustrated a bar-like retrofitting device for this purpose, as it is applied to the subdivision of the bin of an open-topped refuse container of the type provided by department stores and the like for the use of their employees in disposing of paper and other refuse at the work stations provided for the employees by the stores.

In the drawings.

PREFERRED MODE FOR CARRYING OUT THE INVENTION

Figure 2:
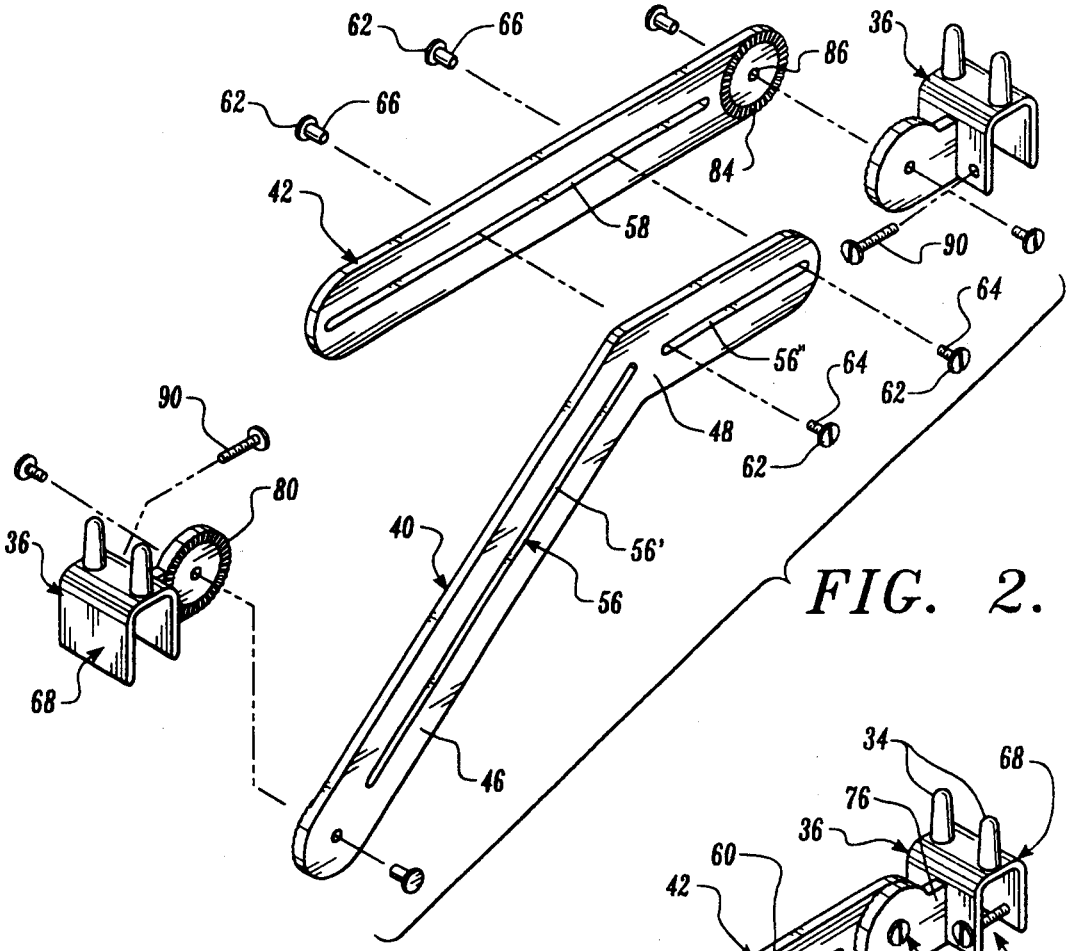
FIG. 2 is an exploded perspective view of the device.
Figure 1:
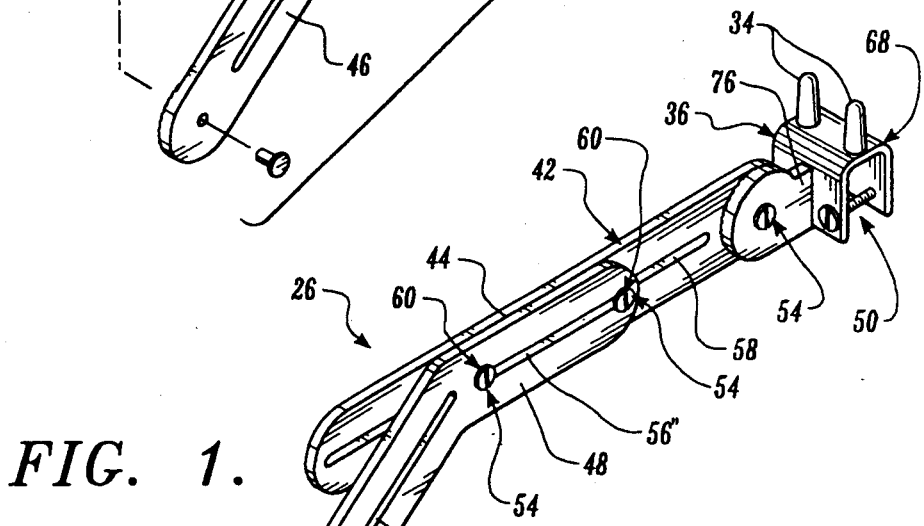
FIG. 1 is a perspective view of the retrofitting device.
Figure 3:
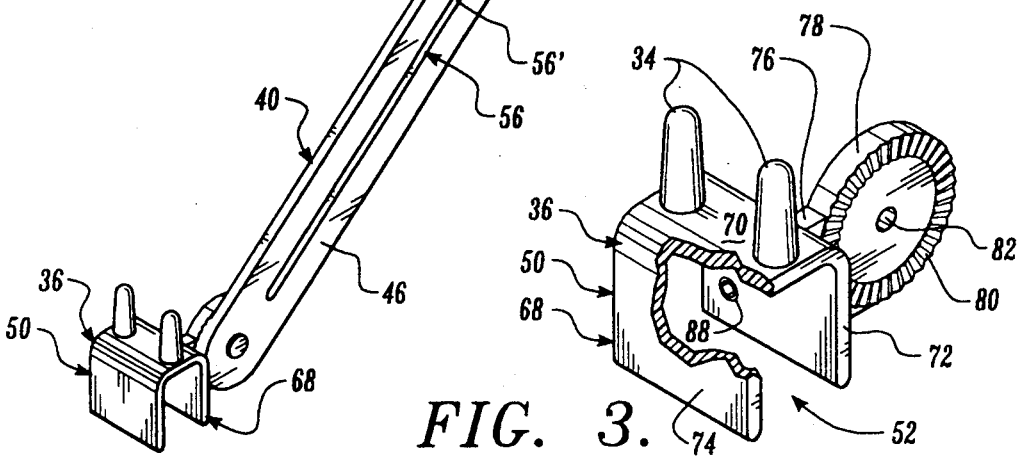
FIG. 3 is a partially removed perspective view of one saddle of the device.
Figure 4:
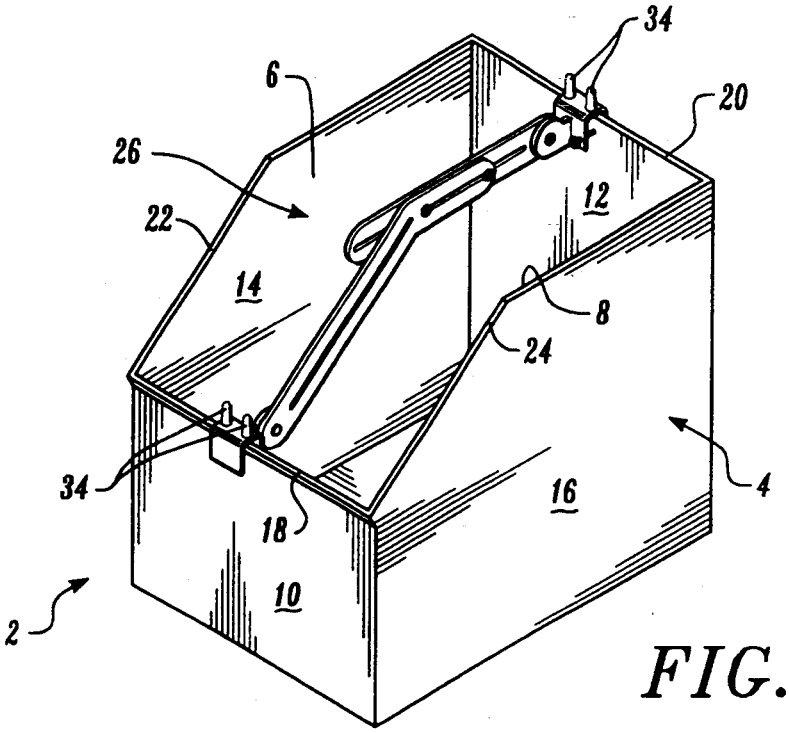
FIG. 4 is a perspective view of the container after the device has been mounted on the container in one vertical plane thereof.

Referring to the drawings, it will be seen that the refuse container 2 used by department stores and the like, commonly has a quadrilateral wall structure 4 which is generally annular in construction so as to define a bin 6 therewithin. The wall structure also defines a top opening 8 to the bin, a pair of fore and aft walls for the bin, 10 and 12, respectively, on one of the right angular coordinates of the container, a pair of sidewalls 14 and 16 on the other of the right angular coordinates, and rims 18, 20, 22 and 24 about the top opening 8 of the bin 6 on the respective pairs of walls 10, 12, 14 and 16 thereof. Typically, the container is also elongated fore and aft thereof, as shown, and in addition, is constructed so that the fore and aft walls 10 and 12 have varied elevations, with the fore wall 10 being the lower at the lipped rim 18 thereof, so that when the container 2 is housed under a counter (not shown) at the work station for it, the employee or employees at that station can load the bin of it merely by taking the refuse in one hand, dropping that hand below the counter, and then discharging the refuse into the bin through the obliquely inclined top opening 8 thereof.

The container 2 is commonly uncovered, but may have a removable cover or lid (not shown) for the top opening 8 of it.

Figure 5:
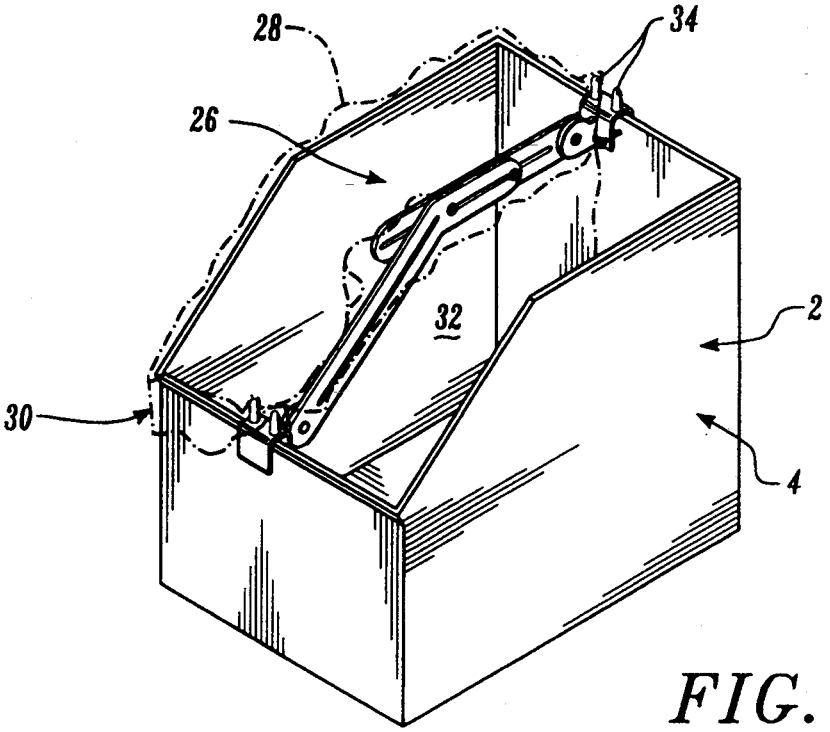
FIG. 5 is a perspective view of the container after a plastic sack has been suspended in phantom in one portion of the bin of the container.

According to my invention, when a decision is made to subdivide the bin 6 into a pair of open-topped receptacles, an elongated molded plastic bar 26 is interposed between the fore and aft walls 10 and 12 of the bin in juxtaposition to a vertical plane (not shown) extending fore and aft of the container intermediate the sidewalls 14 and 16 of the bin, and the bar 26 is supported on the rims 18, 20 of the fore and aft walls of the bin in relatively fixed engagement therewith. Then, the open end portion 28 of an open ended plastic sack 30 is releaseably engaged with the bar, and with the rim 22 of one, 14, of the sidewalls, and the sack 30 is removably suspended in that portion of the bin lying between the aforesaid plane of the container and the one sidewall 14 of the bin. The sack subdivides the bin into a pair of open-topped receptacles for receiving separable components of the refuse, such as the recyclable paper received or generated at the work station on one hand, and the remaining nonrecyclable refuse received or generated at the station, on the other hand. One receptacle is defined by the sack 30 itself, and the other is defined by the remaining portion 32 (FIG. 5) of the bin lying between the plane of the container and the other sidewall 16 of the bin. In practice, however, the open end portion of a second plastic sack (not shown) is commonly releaseably engaged with the bar, and with the rim of the other sidewall 16 of the bin, and the second sack is removably suspended in the remaining portion 32 of the bin so that both receptacles are defined by sacks that can be removed from the bin when in need of emptying or replacement. For ease of illustration, however, only the first mentioned sack 30 is shown, and it is shown in preferred mode, with the open end portion 28 thereof releaseably engaged with the rims 18, 20 of the fore and aft walls 10, 12 of the bin as well, so as to be supported substantially about the entire perimeter of its portion of the bin. Given a second sack, it too would be preferably supported in this same manner.

As shall be explained more fully hereinafter, the open end portion of each sack is releaseably engaged with the bar 26 at a pair of posts 34 relatively upstanding on the respective end portions 36 thereof, and is commonly engaged by folding and stretching the open end portion of the sack over the posts. At the same time, the open end portion of the sack is also folded over the rim of the respective side wall, and the rims of the fore and aft walls, to support the sack about the entire perimeter of its respective portion of the bin.

Figure 6:
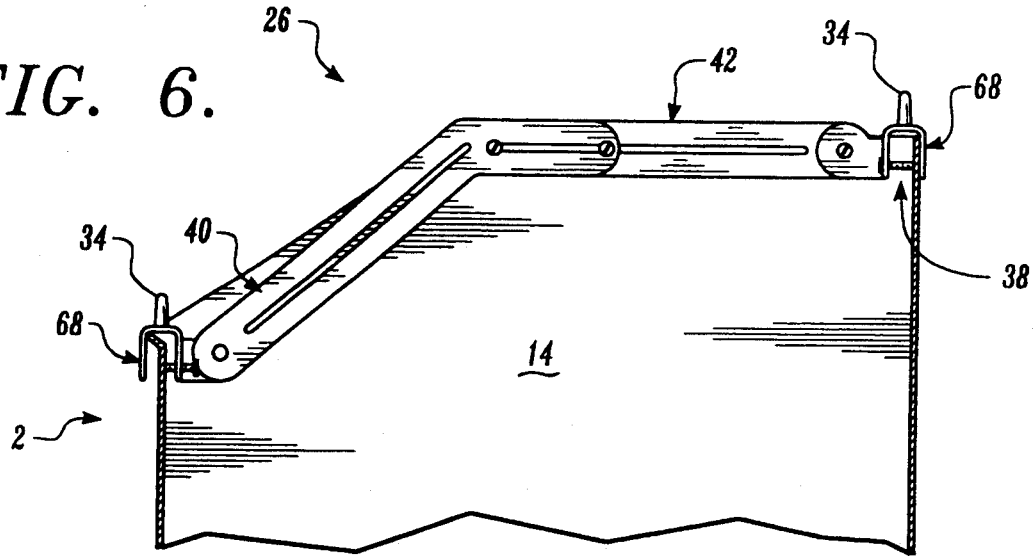
FIG. 6 is a part cross sectional view of the container at the vertical plane of the device.
Figure 7:
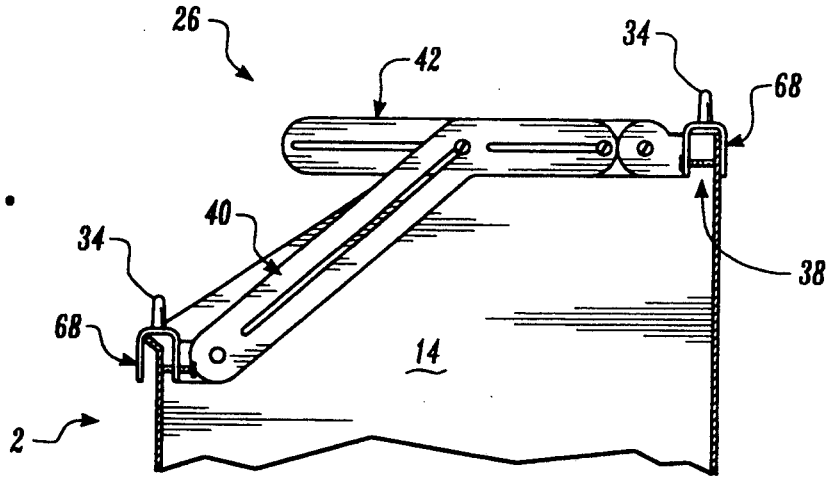
FIG. 7 is a similar view of the container when the rods of the device have been shifted in relationship to one another to fit within a container having a shorter span fore and aft thereof.
Figure 8:
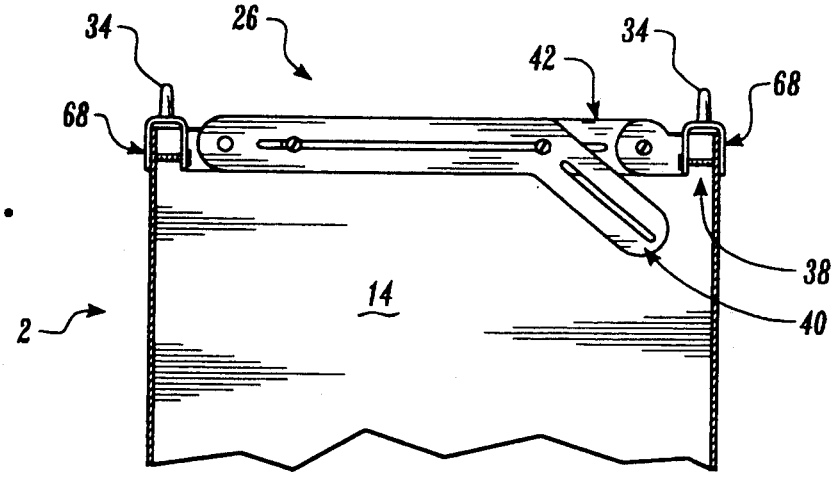
FIG. 8 is a view similar to that of FIGS. 6 and 7, but with respect to a container of shorter span in which the fore and aft rims of the container have a common elevation and the rods of the device have been disconnected, and then reconnected at a different section of the crooked rod to enable the device to span between the rims of such a container.

Preferably, the bar 26 is also clamped to the rims of the fore and aft walls at 38 (FIGS. 6–8), so that in addition to being fixedly engaged fore and aft of the container, the bar is also secured against movement in the planes of the respective walls. This in turn renders the sack 30 more readily disengageable from the bar, and more readily liftable from its portion of the bin, when it is to be removed therefrom.

To span between the fore and aft walls of several variably sized containers with fore and aft rims of varied elevation, and to be supportable on the rims thereof, the bar 26 is divided into a pair of elongated molded plastic rods 40 and 42 having a joint 44 therebetween; and at installation, the rods are shifted in relation to one another at the joint to span between the walls 10, 12, and then the rods are interlocked with one another at the joint 44 to rigidify the bar, and the bar is supported on the rims 18, 20 of the walls in relatively fixed engagement therewith. Moreover, to account for the variation in the elevations of the rims, one, 40, of the rods is divided into a pair of elongated sections 46, 48, the sections 46, 48 are angularly interconnected with one another to form a crooked rod, and the rods 40, 42 are interlocked with one another at the joint 44 to form a crook in the bar 26 when the bar is rigidified. Additionally, to more cleanly support the bar on the rims, a pair of molded plastic saddles 50 is rotatably mounted on the relatively remote end portions of the rods, to form the end portions 36 of the bar 26, and after the relatively adjacent end portions of the rods are interconnected with one another to form the rods into the main body of the bar, the saddles 50 are rotated in relation to the main body of the bar, and then rested on the walls 10, 12 and fixedly engaged with the main body of the bar and with the rims 18, 20 of the walls to support the bar on the rims before the open end portion of a sack is releaseably engaged with the bar and the rim of one sidewall. To fixedly engage the saddles 50 with the rims, the saddles have recesses 52 in the bottoms thereof, and in resting them on the rims 18, 20, the saddles are straddled about the rims so as to receive the rims in the recesses 52 thereof.

More particularly, the rods 40, 42 are flat and are operatively juxtaposed face to face of one another in the plane of the container so as to have relatively adjacent and relatively remote ends, respectively. The faces of the relatively adjacent end portions of the rods are operatively overlapped and abutted with one another along parallels to the plane so as to form the joint 44 between the rods, and releasable interlock means 54 are interconnected between the overlapping portions of the rods so that they can be shifted in relation to one another for purposes of spanning between the rims 18, 20 of the fore and aft walls 10, 12, and then releaseably interlocked with one another to rigidify the bar. Specifically, the rods 40, 42 are given elongated slots 56, 58 on the longitudinal axes thereof, the slots are registered with one another at the overlapping relatively adjacent end portions of the rods, and a pair of metal pins 60 with flanged ends 62 are slideably engaged in the overlapping portions of the slots to interconnect the rods at the joint 44 therebetween. Additionally, the pins 60 comprise pairs of male/female fasteners 64,66 which are threadedly engaged with one another in the slots, so that when the bar has the appropriate length to span between the rims 18, 20 of the walls 10, 12, the fasteners can be tightened to clamp the rods together and rigidify the bar.

To account for the varying elevations of the rims 18, 20, in addition to one, 40, of the rods having a pair of relatively longer and shorter sections 46, 48 which are obliquely angularly interconnected with one another as indicated, to form a crook therein, each section 46, 48 of the rod 40 has a slot 56' or 56'' therein, and when the bar is interposed between fore and aft walls of varying elevation, such as those of the container shown, the relatively shorter section 48 of the crooked rod is releaseably interlocked with the other rod 42, as in FIGS. 1–7, to span between the rims of the walls. On the other hand, when the rims have a common elevation, then the pins 60 are removed, reseated in the groove 56' of the relatively longer section 46 of the crooked rod 40, and the crooked rod is releaseably interlocked with the other rod 42 to form a rectilinear bar which is more adapted to span between rims of common elevations, as in FIG. 8.

The saddles 50 take the form of inverted U-shaped cleats 68 with bight portions 70 and legs 72, 74 depending therefrom, and open ended recesses 52 therebetween. One leg 72 of each cleat has a lug 76 outstanding thereon, at a right angle thereto, and the outboard end portion of the lug has a rounded ear 78 thereon which is equipped in turn with a ratchet wheel 80 on one side thereof, and a hole 82 at the center thereof. When the cleat is rotatably mounted on the corresponding rod, the adjacent end portion of the rod is given a corresponding ratchet wheel 84, and a hole 86 at the center thereof, and the two wheels 80, 84 are arranged in opposition to one another with the holes 82, 86 coaxial, so that releasable interlock means like those employed at 54, can be interposed in the holes to releaseably engage the wheels with one another when the cleats have the appropriate angular orientation on the bar for straddling about the rims 18, 20 of the walls 10, 12. In addition, threaded metal bushings 88 are heat seated in the inside legs 72 of the respective cleats, and metal set screws 90 are threadedly engaged in the bushings 88 from the outsides of the cleats, to be engaged with the rims of the walls for purposes of clamping the cleats to the walls and thus preventing them from shifting in the planes of the walls when the bar is in the desired position on the container.

Pairs of posts 34 upstand on the respective bight portions 70 of the cleats and can accommodate the folded open end portions of both sacks 30 so that only a single bar 26 is needed to subdivide the bin into the two receptacles provided by the sacks.

When the sacks 30 are in need of emptying or replacement, the open end portion of each can be disengaged from the bar, and from the rims of the walls, and then the sack can be lifted from its portion of the bin, and removed to a dumping site where it may be emptied and returned, or discarded altogether along with the refuse therein. Casters (not shown) on the bottom of the container make it possible to remove it from under the counter at this time, and to wheel the container to the dump site if desired, before the sacks are lifted from the bin.

I claim:

1. In the process of subdividing the bin of an open topped refuse container into a pair of open topped receptacles within which to load separable components of the refuse, the container having right angular coordinates therewithin, a generally annular wall structure defining the bin therewithin, a top opening to the bin, pairs of opposing sides of the bin on the right angular coordinates of the container, and rims about the top opening of the bin on the pairs of opposing sides thereof, the rims of one of the pairs of opposing sides of the bin having varying elevations, the steps of:

interposing an elongated bar between the one pair of opposing sides of the bin, in juxtaposition to a vertical plane of the container extending intermediate the other of the pairs of opposing sides of the bin, dividing the bar into a pair of elongated rods having a joint therebetween, dividing one of the rods into a pair of elongated sections, angularly interconnecting the sections with one another to form a crooked rod, shifting the rods in relation to one another at the joint to span between the rims of the one pair of opposing sides of the bin, interlocking the rods with one another at the joint to rigidify the bar and to form a crook in the bar when the bar is rigidified, supporting the bar on the rims of the one pair of opposing sides of the bin in relatively fixed engagement therewith, releaseably engaging the open end portion of an open ended sack with the bar and with the rim of one of the other pair of opposing sides of the bin, and removably suspending the sack in that portion of the bin lying between the aforesaid plane of the container and the one side of the other pair of opposing sides of the bin, to subdivide the bin into a pair of open topped receptacles for receiving the separable components of the refuse.

2. The process according to claim 1 further comprising releaseably engaging the open end portion of a second open ended sack with the bar, and with the rim of the other side of the other pair of opposing sides of the bin, and removably suspending the second sack in the remaining portion of the bin lying between the plane of the container and the other side of the other pair of opposing sides of the bin.

3. The process according to claim 2 wherein the open end portion of each sack is releaseably engaged with the bar at posts relatively upstanding on the respective end portions thereof.

4. The process according to claim 3 wherein the sacks are made of readily foldable, stretchable sheet material, and the open end portion of each sack is folded over the posts and the rim of the respective side of the other pair of opposing sides of the bin, in stretch condition among the posts and rim.

5. The process according to claim 1 further comprising releaseably engaging the open end portion of the sack with the rims of the one pair of opposing sides of the bin, so that the sack is supported substantially about the entire perimeter of the aforesaid portion of the bin.

6. The process according to claim 1 further comprising clamping the bar to the rims of the one pair of opposing sides of the bin, so as to secure the bar against movement in the planes of the respective sides.

7. The process according to claim 1 further comprising rotatably mounting a pair of saddles on the relatively remote end portions of the rods to form the end portions of the bar, interlocking the relatively adjacent end portions of the rods with one another to form the rods into the main body of the bar, rotating the saddles in relation to the main body of the bar, resting the saddles on the rims of the one pair of opposing sides of the bin, and fixedly engaging the saddles with the main body of the bar and the rims on the one pair of opposing sides of the bin, so as to support the bar on said rims.

8. The process according to claim 7 wherein the saddles have recesses in the bottoms thereof and in resting the saddles on the rims of the one pair of opposing sides of the bin, the saddles are straddled about the one pair of opposing sides of the bin so as to receive the rims in the recesses thereof.

9. The process according to claim 8 further comprising clamping the saddles to the rims so as to secure the bar against movement in the planes of the respective one pair of opposing sides of the bin.

10. In a device for use with an open ended sack in subdividing the bin of an open topped refuse container into a pair of open topped receptacles for receiving separable components of the refuse, the container having right angular coordinates therewithin, a generally annular wall structure defining the bin therewithin, a top opening to the bin, pairs of opposing sides of the bin on the right angular coordinates of the container, and rims about the top opening of the bin on the pairs of opposing sides thereof, the combination of:

an elongated bar for interposition between one of the pairs of opposing sides of the bin, in juxtaposition to a vertical plane of the container extending intermediate the other of the pairs of opposing sides of the bin, means for supporting the bar on the rims of the one pair of opposing sides of the bin in relatively fixed engagement therewith, attachment means on the bar whereby the open end portion of the sack can be releaseably engaged with the bar and with the rim of one of the other pair of opposing sides of the bin, and the sack removably suspended in that portion of the bin lying between the aforesaid plane of the container and the one side of the other pair of opposing sides of the bin, to subdivide the bin into a pair of open topped receptacles for receiving the separable components of the refuse, the bar comprising a pair of elongated rods which are operatively juxtaposed to the plane of the container so as to have relatively adjacent and relatively remote ends respectively, the relatively adjacent end portions of the rods being operatively overlapped and abutted with one another along parallels to the plane so as to form a joint between the rods, releasable interlock means interconnected between the overlapping portions of the rods at the joint, and adjustment means in the connection between the releasable interlock means and the rods whereby the rods can be shifted in relation to one another to span between the rims of the one pair of opposing sides of the bin, and then releaseably interlocked with one another to rigidify the bar, one of the rods having a pair of sections therein which are obliquely angularly interconnected with one another to form a crook in the one rod, and the other rod being overlapped and abutted with one of the sections to form a crook in the bar itself, when the rims of the one pair of opposing sides of the bin have varying elevations.

11. The device according to claim 10 wherein the attachment means take the form of posts relatively upstanding on the respective end portions of the bar.

12. The device according to claim 10 further comprising means for clamping the bar to the rims of the one pair of opposing sides of the bin.

13. The device according to claim 10 wherein the adjustment means take the form of pin and slot means in the releasable interlock means and the overlapping portions of the rods respectively.

14. In a device for use with an open ended sack in subdividing the bin of an open topped refuse container into a pair of open topped receptacles for receiving separable components of the refuse, the container having right angular coordinates therewithin, a generally annular wall structure defining the bin therewithin, a top opening to the bin, pairs of opposing sides of the bin on the right angular coordinates of the container, and rims about the top opening of the bin on the pairs of opposing sides thereof, the combination of:

an elongated bar for interposition between one of the pairs of opposing sides of the bin, in juxtaposition to a vertical plane of the container extending intermediate the other of the pairs of opposing sides of the bin, means for supporting the bar on the rims of the one pair of opposing sides of the bin in relatively fixed engagement therewith, and attachment means on the bar whereby the open end portion of the sack can be releaseably engaged with the bar and with the rim of one of the other pair of opposing sides of the bin, and the sack removably suspended in that portion of the bin lying between the aforesaid plane of the container and the one side of the other pair of opposing sides of the bin, to subdivide the bin into a pair of open topped receptacles for receiving the separable components of the refuse, the bar comprising an elongated main body and a pair of saddles rotatably mounted on the ends of the main body of the bar to form the end portions of the bar, and the saddles being rotatable in relation to the main body of the bar to rest on the rims of the one pair of opposing sides of the bin when said rims are disposed at varying elevations.

15. The device according to claim 14 further comprising releasable interlock means interconnected between the saddles and the end portions of the main body of the bar whereby the respective saddles can be rotated in relation to the main body of the bar and then interlocked with the same in varying angular orientations thereabout.

16. The device according to claim 14 wherein the saddles have recesses in the bottoms thereof and are adapted so that in resting on the rims, the saddles are straddled about the rims so as to receive the rims in the recesses thereof.

17. The device according to claim 16 further comprising means on the saddles for clamping the bar to the rims of the one pair of opposing sides of the bin.

18. The device according to claim 14 wherein the main body of the bar comprises a pair of elongated rods which are operatively juxtaposed to the plane of the container so as to have relatively adjacent and relatively remote ends respectively, the relatively adjacent end portions of the rods overlapping and abutting one another along parallels to the plane so as to form a joint between the rods, releasable interlock means interconnecting the overlapping portions of the rods at the joint, and adjustment means in the connection between the releasable interlock means and the overlapping portions of the rods whereby the rods can be shifted in relation to one another to span between the rims of the one pair of opposing sides of the bin, and then releaseably interlocked with one another to rigidify the bar.

19. A kit for subdividing the bin of an open-topped refuse container into a pair of open-topped receptacles for receiving separable components of the refuse, the container having right angular coordinates therewithin, a generally annular wall structure defining the bin therewithin, a top opening to the bin, pairs of opposing sides of the bin on the right angular coordinates of the container, and rims about the top opening of the bin on the pairs of opposing sides thereof, comprising:

an elongated bar for interposition between one of the pairs of opposing sides of the bin, in juxtaposition to a vertical plane of the container extending intermediate the other of the pairs of opposing sides of the bin, means for supporting the bar on the rims of the one pair of opposing sides of the bin in relatively fixed engagement therewith, an open ended sack, and attachment means on the bar whereby the open end portion of the sack can be releaseably engaged with the bar and with the rim of one of the other pair of opposing sides of the bin, and the sack removably suspended in that portion of the bin lying between the aforesaid plane of the container and the one side of the other pair of opposing sides of the bin, to subdivide the bin into a pair of open-topped receptacles for receiving the separable components of the refuse, the bar comprising a pair of elongated rods which are operatively juxtaposed to the plane of the container so as to have relatively adjacent and relatively remote ends respectively, the relatively adjacent end portions of the rods being operatively overlapped and abutted with one another along parallels to the plane so as to form a joint between the rods, releasable interlock means interconnected between the overlapping portions of the rods at the joint, and adjustment means in the connection between the releasable interlock means and the rods whereby the rods can be shifted in relation to one another to span between the rims of the one pair of opposing sides of the bin, and then releaseably interlocked with one another to rigidify the bar, one of the rods having a pair of sections therein which are obliquely angularly interconnected with one another to form a crook in the one rod, and the other rod being overlapped and abutted with one of the sections to form a crook in the bar itself, when the rims of the one pair of opposing sides of the bin have varying elevations.

20. In combination, an open-topped refuse container having right angular coordinates therewithin, a generally annular wall structure defining a bin therewithin, a top opening to the bin, pairs of opposing sides of the bin on the right angular coordinates of the container, and rims about the top opening of the bin on the pairs of opposing sides thereof, the rims of one of the pairs of opposing sides of the bin having varying elevations, an elongated bar interposed between the one pair of opposing sides of the bin in juxtaposition to a vertical plane of the container extending intermediate the other of the pairs of opposing sides of the bin, and having attachment means thereon, means operating to support the bar on the rims of the one pair of opposing sides of the bin in relatively fixed engagement therewith, and an open ended sack releaseably engaged at the open end portion thereof with the attachment means on the bar and with the rim of one of the other pair of opposing sides of the bin, and removably suspended in that portion of the bin lying between the aforesaid plane of the container and the one side of the other pair of opposing sides of the bin, so as to subdivide the bin into a pair of open topped receptacles for receiving separable components of the refuse, the bar comprising a pair of elongated rods which are juxtaposed to the plane of the container so as to have relatively adjacent and relatively remote ends respectively, the relatively adjacent end portions of the rods being overlapped and abutted with one another along parallels to the plane so as to form a joint between the rods, releasable interlock means interconnected between the overlapping portions of the rods at the joint, and adjustment means in the connection between the releasable interlock means and the rods whereby on releasing the interlock means, the rods can be shifted in relation to one another between the rims of the one pair of opposing sides of the bin, and then releaseably interlocked with one another to rigidify the bar, one of the rods having a pair of sections therein which are obliquely angularly interconnected with one another to form a crook in the one rod, and the other rod being overlapped and abutted with one of the sections to form a crook in the bar itself.

21. The combination according to claim 20 wherein the attachment means take the form of posts relatively upstanding on the respective end portions of the bar.

* * * * *